United States Patent [19]

Eggert, Jr.

[11] 4,278,029

[45] Jul. 14, 1981

[54] RESILIENT RAILWAY CAR TRUCK SUSPENSION

[75] Inventor: Walter S. Eggert, Jr., Huntington Valley, Pa.

[73] Assignee: The Budd Company, Troy, Mich.

[21] Appl. No.: 62,772

[22] Filed: Aug. 1, 1979

[51] Int. Cl.[3] ..... B61F 5/30; B61F 5/50; B61F 15/18

[52] U.S. Cl. ..... 105/224.1; 267/3

[58] Field of Search ..... 105/182 R, 224.1; 267/3

[56] References Cited

U.S. PATENT DOCUMENTS

| | | | |
|---|---|---|---|
| 2,214,762 | 9/1940 | Eksergian | 105/182 R X |
| 3,606,295 | 9/1971 | Appleton | 105/224.1 X |
| 3,945,327 | 3/1976 | Henricot | 105/224.1 |
| 4,044,689 | 8/1977 | Eggert, Jr. | 105/224.1 X |
| 4,134,343 | 1/1979 | Jackson | 105/224.1 X |

*Primary Examiner*—Joseph F. Peters, Jr.
*Assistant Examiner*—Howard Beltran
*Attorney, Agent, or Firm*—A. L. Trueax, Jr.

[57] ABSTRACT

A primary suspension system is disposed between the axle on journal bearings and the sideframe of a truck. Flexible means, secured to the sideframe, extends around and is spaced from the axle on journal bearings. A circular structure supports the axle and journal bearings, and includes a portion extending radially away from the axis of said axle into the center of said flexible means and is attached to two spaced surfaces which also extend radially away from the axis of the axle.

10 Claims, 6 Drawing Figures

RESILIENT RAILWAY CAR TRUCK SUSPENSION

BACKGROUND OF THE INVENTION

In a railway car, primary and secondary suspension systems are employed. The primary suspension system generally refers to the suspension between the journal assembly and the truck frame. The secondary suspension system generally refers to the suspension, such as air or mechanical springs, between a bolster on the truck and the car body. The present invention is directed to primary suspension systems.

Such primary suspension systems have taken numerous different forms, generally involving metal springs on sliding devices. Some so-called "soft" primary systems have springs on both ends and include gears for controlling the movements of the axle journals up and down. With these arrangements, shock absorbers or other damping means must be employed.

It is the object of this invention to provide an improved primary suspension system in a railway car.

It is a further object of this invention to provide an improved soft primary suspension system for a railway car which minimizes wayside noise and vibrations and which minimizes damage to the track.

It is still a further object of this invention to provide an improved primary suspension system which does not require bottom metal springs or sliding devices.

SUMMARY OF THE INVENTION

In accordance with the present invention, a railway car having a truck with a sideframe for receiving an axle assembly is provided. A primary suspension system, disposed between the axle assembly and the sideframe, includes flexible means extending around and spaced from the axle assembly and supported in the side frame. A circular structure supports the axle and includes a portion extending radially away from the axis of the axle into the center of the flexible means and is attached to two spaced radially extending surfaces thereof.

Other objects and advantages of the present invention will be apparent and suggest themselves to those skilled in the art, from a reading of the following specification and claims, taken in conjunction with the accompanying drawings.

DESCRIPTION OF THE DRAWINGS

Referring to FIG. 1, a truck 10 of a type which may incorporate the primary suspension system of the present invention is illustrated. The truck 10 is somewhat conventional in design and includes a pair of wheel assemblies 12 and 14, secured to suitable sideframes such as sideframe 16. A bolster 18, supported by the sideframes, holds an air spring 20. An antiroll bar 22, extends across the car and includes a link 24, which is connected to brackets 26, mounted to the bolster. A stabilizer 28, is connected between the bolster and the wheel axle assembly.

All of the various items mentioned so far are found in many conventional trucks designed to support railway car bodies.

Figure 1:
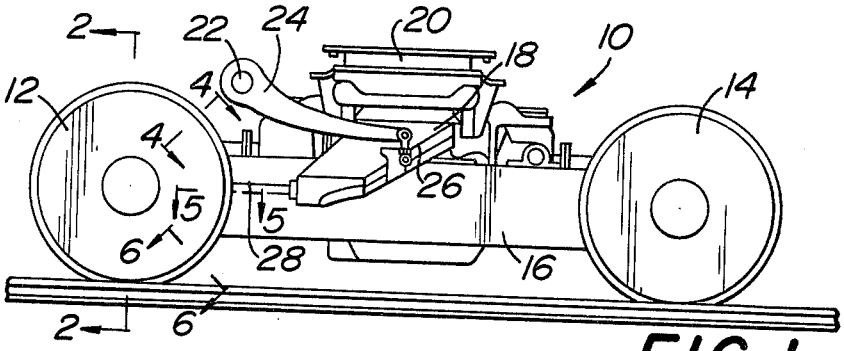
FIG. 1 is a sideview of a truck for supporting a railway car, of the type which may utilize the primary suspension system of the present invention.
Figure 3:
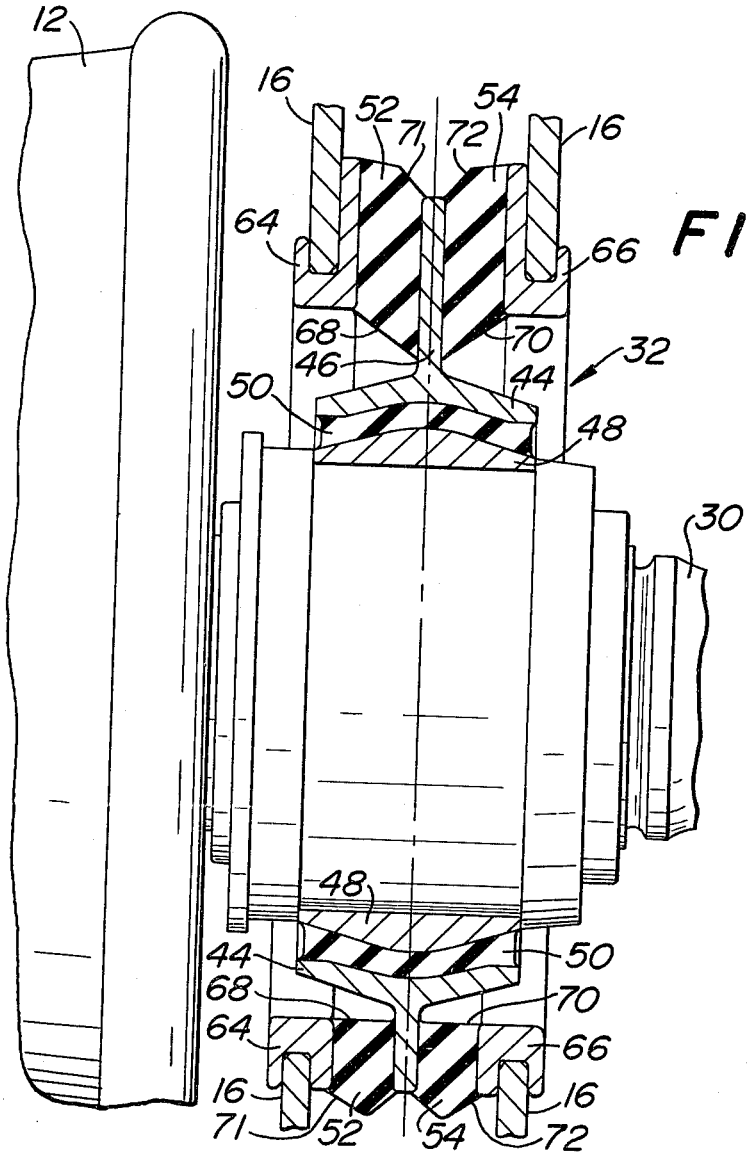
FIG. 3 is a cross-sectional view, taken along lines 2—2 when the primary suspension system is deflected.
Figure 2:
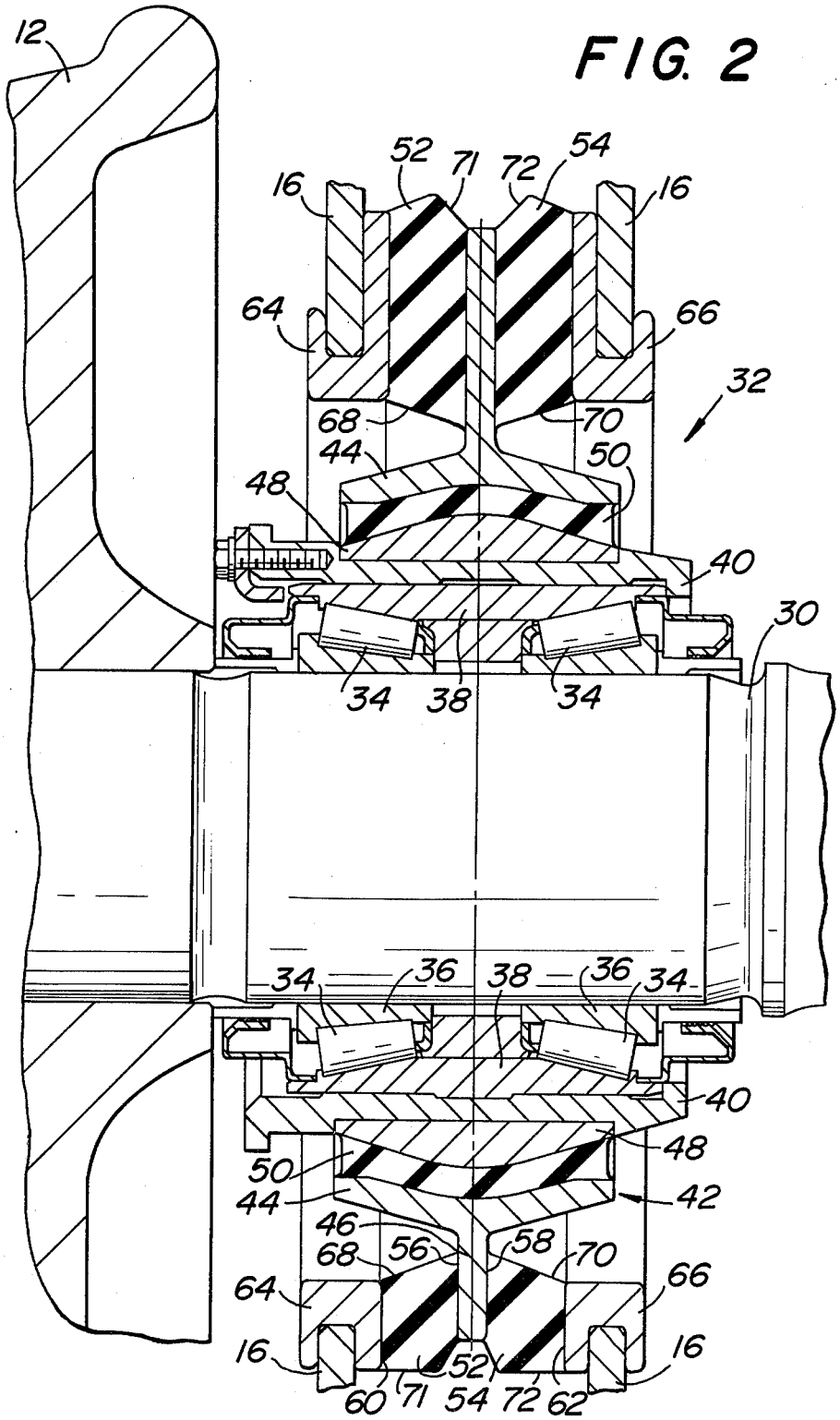
FIG. 2 is a cross-sectional view, taken along lines 2—2 of FIG. 1 when the primary suspension system is not deflected.

Referring to the remaining figures of the drawings, FIGS. 2 and 3 are similar except that FIG. 2 illustrates the primary suspension system when it is not deflected or free of any applied load, whereas FIG. 3 illustrates the suspension system when a load is applied and the primary suspension system is deflected and FIG. 2 shows more details of the journal assembly. An axle 30 is connected to the wheel 12 to provide a wheel assembly. A primary suspension system 32 is disposed between the sideframe 16 and the axle journal assembly. As illustrated in FIG. 2, the axle 30 rotates within journal bearings 34. The bearings 34 roll on inner ring sleeves 36 and outer ring 38. The journal assembly, including the roller bearings 34 and rings 36 and 38, are supported by a journal support 40. The journal arrangement and axle arrangement thus far described are conventional and found in many conventional types of trucks.

The primary suspension comprises a bearing support member 42, which includes an inner surface 44 extending around the journal assembly and an outwardly radially extending portion 46. A suitably shaped ring 48 and a flexible ring 50 are disposed around the journal bearing assembly between the journal bearing assembly and the bearing support member 42.

The primary suspension system further comprises flexible means, including a pair of flexible rings 52 and 54, which provide center surfaces 56 and 58, which are attached to the portion 46 of the bearing support member 42. The outer surfaces 60 and 62 are connected to support elements 64 and 66, respectively, which in turn are secured to the sideframe 16.

FIG. 2 illustrates the primary suspension system, particularly the rings 52 and 54, in an undeflected condition. As illustrated, the outer and inner diameters of the rings are asymmetrical. The reason for this is to provide more flexible means between the car body and axle journals. Under these conditions, no load is being applied to the suspension system. The upper portion of the rings 52 and 54 are wider than the portion toward the bottom. In other words, the outer circumferences of the rings 52 and 54 are not concentric with their center openings or with the axis of the axle. The radial distances of the rings 52 and 54 taper gradually as they extend from around the top of the axle 30, becoming more narrow as they approach the bottom of the axle 32. The extending portion 46 of the support 42 corresponds in size to the inner surfaces of the rings 52 and 54, being likewise non-concentric with respect to the axis of the axle. In an undeflected condition, the top and bottom portions of inner surfaces 68 and 70 extend angularly inwardly toward the axis of the axle 30. The bottom portions of the outer surfaces 71 and 72 both include angular areas which extend in an angular direction toward the end portion 46 of the support 42 and flat portions, as illustrated. The upper portions of the outer surfaces 71 and 72 are pointed upwardly away from the axis of the axle 30.

When the primary suspension system is flexed, the rings 52 and 54 become deflected in the manner illustrated in FIG. 3. The rings 52 and 54 deflect downwardly so that the inner surfaces 68 and 70 of the bottom portion becomes flat and the inner surfaces 68 and 70 of the upper portions deflect inwardly and downwardly at an angle toward the portion 46 of the support member 42. At the same time, the bottom portions of the sections 71 are deflected at two pointed angles while the top portions are partly flat and partly angular in the manner illustrated. During deflection, the axle 30 and its associated journal bearing assembly moves downward and pushes the bearing support member 42 downward. This causes the rings 52 and 54 to be deflected in the manner illustrated.

Figure 4:
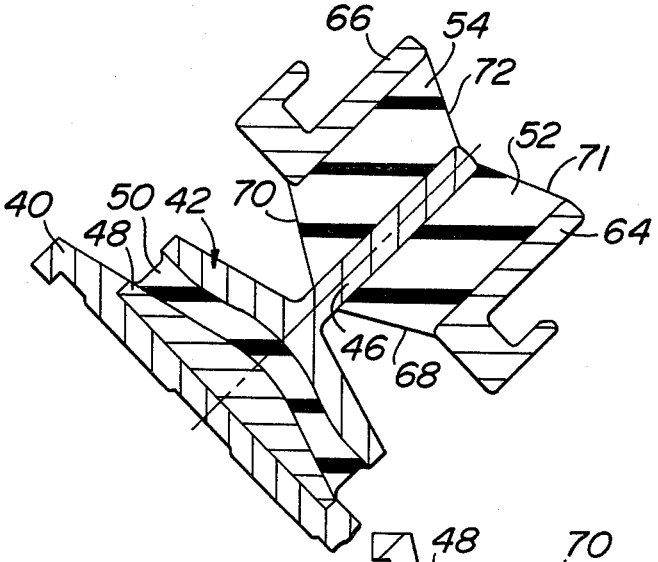
FIG. 4 is a cross-sectional view, taken along lines 4—4 of FIG. 1 when the primary suspension system is deflected.
Figure 5:
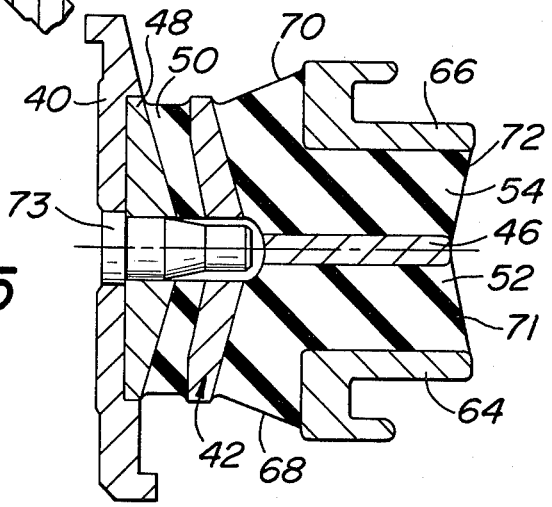
FIG. 5 is a cross-sectional view, taken along lines 5—5 of FIG. 1 when the primary suspension system is deflected.
Figure 6:
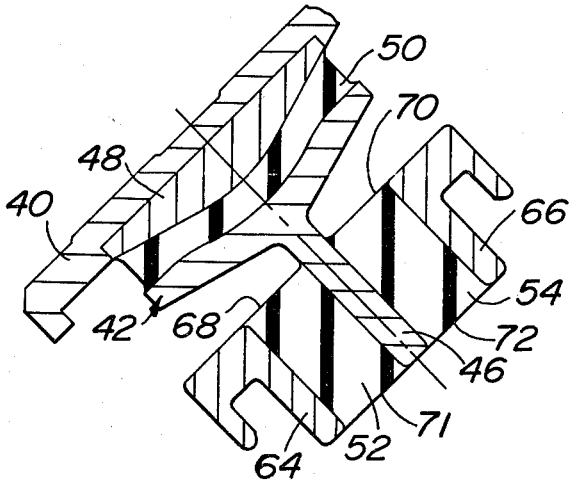
FIG. 6 is a cross-sectional view, taken along lines 6—6 of FIG. 1 when the primary suspension system is deflected.

FIGS. 4, 5 and 6 illustrate the various positions of the flexible rings 50 and 52 as they extend around the axle while the system is being deflected.

As illustrated in FIG. 5, a pair of indexing pins are provided at both sides of the axle with only one being illustrated. The indexing pin 73 extends through the bearing support member 42, flexible ring 50, ring 48, and into an opening in the journal support 40. These indexing pins, disposed on either side of the rings 52 and 54, provide a lateral fail-safe system and maintains the ring in position. The projecting portion 46 extending centrally into the flexible means, including the rings 52 and 54, provide a self-guiding suspension system.

The rubber, or other flexible material comprising the rings 52 and 54, provides all the items necessary for the suspension and, therefore, there are no sliding or rubbing joints of any members involved. By having the projecting portion 46 symmetrical about the center of the flexible means, a double area of the rubber, or flexible material, is provided by the rings 52 and 54. By doubling the area of the rubber contacted, it is possible to work at lower stresses, obtain lower spring rates and therefore provide a more practical soft primary system.

It is noted that the load from the car body is applied to the primary system in the center from the journal arrangement. The load, however, is taken from the outside of the connecting member, or supporting member, for the journals.

The flexible ring 50 provides rotational or self-aligning for the suspension system. The two rubber rings 52 and 54 provide shearing members on either side. This, in turn, loads the support elements 64 and 66 mounted to the sideframe 16 inside and outside of the primary suspension.

The system described is primarily directed to vertical suspension. In such a system, relatively high spring rates are provided for lateral and longitudinal motion. The design illustrated assures high rigid control of the wheel and axle, both longitudinally and vertically, while at the same time providing a very soft suspension vertically.

In many standard systems, the car may have a static deflection of about 1/10th of an inch. This provides a 1/10th of an inch deflection for the weight of the car, though it may be said that if there is roughly 13,000 pounds of axle pressure then the 1/10th of an inch amounts of 130,000 inch pounds. In the primary suspension system illustrated, it is possible to consider going to about 26,000 inch pounds. At the same time, the lateral and longitudinal spring rates remain high.

The particular grade of rubber used will naturally affect the spring rate. In a preferred embodiment, a 50% durometer rubber was used. However, you could also use 45%, 50%, 55%, 60% and all the way down to 90% durometer, depending upon the force and kind of deflections required.

The rings 52 and 54 have been illustrated as being separate rings. However, it is possible that the outer end surfaces of the rings may be bolted together. It is also possible that the rings 52 and 54 may be made as a single piece, somewhat in the shape of a horseshoe, to provide basically the same type of operation as that described.

What is claimed is:

1. In a railway car having a truck with a sideframe for receiving an axle disposed to ride on journal bearings, a primary suspension system disposed between said axle on journal bearings and said sideframe comprising:

(a) means for attaching said primary suspension system on said side frame, (b) flexible support means secured to said attaching means, (c) radial support structure spaced from said journal bearings and having a surface resiliently supported on a journal support of said journal bearings, (d) said flexible support means having a portion secured to said radial support structure for flexibly supporting said side frame on said axle having said flexible support means in shear.

2. A primary suspension system as set forth in claim 1 wherein said flexible support means comprises a pair of spaced flexible rings.

3. A primary suspension system as set forth in claim 2 wherein said flexible rings are secured between said sideframe and said support structure and disposed to be freely vertically deflected.

4. A primary suspension system as set forth in claim 3 wherein said flexible rings are of substantially equal thicknesses.

5. A primary suspension system as set forth in claim 4 wherein the inner and outer diameters of said flexible rings are asymmetrical with respect to the axis of said axle so that said flexible rings are wider in the area above said axle than below said axle.

6. A primary suspension system as set forth in claim 5 wherein a pair of indexing pins extend into said support structure to maintain said flexible rings in position.

7. A primary suspension system as set forth in claim 6 wherein said radial support structure includes a main section surrounding said axle and journal bearings, with said portion being integral with said main section and extending around said main section.

8. A primary suspension system as set forth in claim 7 wherein said flexible means maintains said axle and journal bearings spaced from said sideframe.

9. A primary suspension system as set forth in claim 8 wherein a connecting flexible ring is disposed between said journal bearings and said extending portion of said radial support structure.

10. A primary suspension system as set forth in claim 9 wherein said attaching means include support elements connected between said pair of flexible rings and said sideframe.

* * * * *